US009895789B2

(12) United States Patent
Konyashin et al.

(10) Patent No.: US 9,895,789 B2
(45) Date of Patent: Feb. 20, 2018

(54) POLYCRYSTALLINE DIAMOND COMPOSITE COMPACT ELEMENTS AND METHODS OF MAKING AND USING SAME

(71) Applicant: Element Six GmbH, Burghaun (DE)

(72) Inventors: Igor Yurievich Konyashin, Burghaun (DE); Bernd Heinrich Ries, Burghaun (DE); Frank Friedrich Lachmann, Burghaun (DE)

(73) Assignee: ELEMENT SIX GMBH, Burghaun (DE)

( * ) Notice: Subject to any disclaimer, the term of this patent is extended or adjusted under 35 U.S.C. 154(b) by 656 days.

(21) Appl. No.: 14/365,577

(22) PCT Filed: Dec. 13, 2012

(86) PCT No.: PCT/EP2012/075390
§ 371 (c)(1),
(2) Date: Jun. 13, 2014

(87) PCT Pub. No.: WO2013/087773
PCT Pub. Date: Jun. 20, 2013

(65) Prior Publication Data

US 2014/0311810 A1 Oct. 23, 2014

Related U.S. Application Data

(60) Provisional application No. 61/576,891, filed on Dec. 16, 2011.

(30) Foreign Application Priority Data

Dec. 16, 2011 (GB) ..... 1121673.6

(51) Int. Cl.
*E21B 10/567* (2006.01)
*B24D 3/10* (2006.01)
(Continued)

(52) U.S. Cl.
CPC ..... *B24D 3/10* (2013.01); *B22F 3/12* (2013.01); *C22C 26/00* (2013.01); *C22C 29/067* (2013.01);
(Continued)

(58) Field of Classification Search
CPC ..... E21B 10/567; E21B 10/55; E21B 10/573; E21B 10/5735; B22F 3/12; B22F 3/14;
(Continued)

(56) References Cited

U.S. PATENT DOCUMENTS

2009/0044415 A1 2/2009 Fujino
2011/0061944 A1 3/2011 Scott et al.

FOREIGN PATENT DOCUMENTS

EP 2199418 A2 6/2010
GB 2393449 A 5/2004
(Continued)

OTHER PUBLICATIONS

International Search Report for PCT/EP2012/075390 dated Mar. 26, 2013.

(Continued)

*Primary Examiner* — Yong-Suk Ro
(74) *Attorney, Agent, or Firm* — Bryan Cave LLP

(57) ABSTRACT

A polycrystalline diamond composite compact element comprises a body of polycrystalline diamond material and a cemented carbide substrate bonded to the body of polycrystalline material. The cemented carbide substrate has tungsten carbide particles bonded together by a binder material comprising an alloy of Co, Ni and Cr. The tungsten carbide particles form between 70 weight percent and 95 weight percent of the substrate. The binder material comprises between about 10 to 50 wt. % Ni, between about 0.1 to 10 wt. % Cr, and the remainder weight percent comprising Co. The size distribution of the tungsten carbide particles in the
(Continued)

substrate has fewer than 17 percent of the carbide particles with a grain size of equal to or less than about 0.3 microns, between about 20 to 28 percent of the tungsten carbide particles having a grain size of between about 0.3 to 0.5 microns; between about 42 to 56 percent of the tungsten carbide particles having a grain size of between about 0.5 to 1 microns; less than about 12 percent of the tungsten carbide particles being greater than 1 micron; and the mean grain size of the tungsten carbide particles is about 0.6+0.2 microns.

10 Claims, 1 Drawing Sheet

(51) Int. Cl.

| | |
|---|---|
| ***C22C 26/00*** | (2006.01) |
| ***C22C 29/06*** | (2006.01) |
| ***C22C 29/08*** | (2006.01) |
| ***B22F 3/12*** | (2006.01) |
| ***E21B 10/573*** | (2006.01) |
| *B22F 5/00* | (2006.01) |

(52) U.S. Cl.
CPC ..... *C22C 29/08* (2013.01); *E21B 10/567* (2013.01); *E21B 10/573* (2013.01); *B22F 2005/001* (2013.01); *B22F 2302/10* (2013.01)

(58) Field of Classification Search
CPC ..... B22F 2005/001; B22F 999/00; B22F 2302/10; B24D 3/10; C22C 26/00; C22C 29/08; C22C 29/067
See application file for complete search history.

(56) References Cited

FOREIGN PATENT DOCUMENTS

| | | | |
|---|---|---|---|
| WO | 2006/032982 | A1 | 3/2006 |
| WO | 2007/127680 | A1 | 11/2007 |
| WO | 2011/029773 | A1 | 3/2011 |

OTHER PUBLICATIONS

Search Report for GB1121673.6 dated Jul. 11, 2012.
Search Report for GB1222464.8 dated May 22, 2013.
International Standards Organization Microbeam analysis-electron backscatter diffraction-measurement of average grain size, Section 3.3.2 of ISO FDIS 13067, Geneva, Switzerland 2011.
Roebuck, "Magnetic moment (saturation) measurements on cemented carbide materials", Int. J. Refractory Met., (1996) vol. 14, pp. 419-424.

POLYCRYSTALLINE DIAMOND COMPOSITE COMPACT ELEMENTS AND METHODS OF MAKING AND USING SAME

FIELD

This disclosure relates to polycrystalline diamond (PCD) composite compact elements, tools incorporating the same, and methods for making and using the same.

BACKGROUND

Polycrystalline diamond (PCD) is a super-hard, also known as superabrasive, material comprising a mass of inter-grown diamond grains and interstices between the diamond grains. PCD may be made by subjecting an aggregated mass of diamond grains to an ultra-high pressure and temperature. A material wholly or partly filling the interstices may be referred to as filler material. PCD may be formed in the presence of a sintering aid such as cobalt, which is capable of promoting the inter-growth of diamond grains. The sintering aid may be referred to as a solvent/catalyst material for diamond, owing to its function of dissolving diamond to some extent and catalysing its re-precipitation. A solvent/catalyst for diamond is understood to be a material that is capable of promoting the growth of diamond or the direct diamond-to-diamond inter-growth between diamond grains at a pressure and temperature condition at which diamond is thermodynamically stable. Consequently the interstices within the sintered PCD product may be wholly or partially filled with residual solvent/catalyst material. PCD may be formed on a cobalt-cemented tungsten carbide substrate, which may provide a source of cobalt solvent/catalyst for the PCD.

PCD may be used in a wide variety of tools for cutting, machining, drilling or degrading hard or abrasive materials such as rock, metal, ceramics, composites and wood-containing materials. For example, PCD elements may be used as cutting elements on drill bits used for boring into the earth in the oil and gas drilling industry. Such cutting elements for use in oil and gas drilling applications are typically formed of a layer of PCD bonded to a cemented tungsten carbide-cobalt substrate and, in many of these applications, the temperature of the PCD material may become elevated as it engages a rock formation, workpiece or body with high energy. Unfortunately, mechanical properties of PCD such as hardness and strength tend to deteriorate at high temperatures, largely as a result of residual solvent/catalyst material dispersed within it. Another major problem experienced with such cutters is the relatively low erosion resistance of the carbide substrate of the cutter. This may result in the carbide substrate being eroded very quickly during the drilling process due to mud forming from the coolants used in the drilling process and penetration of abrasive particles from the drilled rock into the carbide substrate. A worn and eroded carbide substrate cannot support the PCD layer attached thereto, with the result that the whole cutter may fail.

There is therefore a need for cemented carbide substrates for attachment to a body of PCD material having improved erosion resistance.

SUMMARY

Viewed from a first aspect there is provided a polycrystalline diamond (PCD) composite compact element comprising:

a body of polycrystalline diamond material; and a cemented carbide substrate bonded to the body of polycrystalline material along an interface;

the cemented carbide substrate comprising tungsten carbide particles bonded together by a binder material, the binder material comprising an alloy of Co, Ni and Cr;

the tungsten carbide particles forming at least 70 weight percent and at most 95 weight percent of the substrate;

wherein the binder material comprises between about 10 to 50 wt. % Ni, between about 0.1 to 10 wt. % Cr, and the remainder weight percent comprising Co;

wherein the size distribution of the tungsten carbide particles in the cemented carbide substrate has the following characteristics:

fewer than 17 percent of the carbide particles have a grain size of equal to or less than about 0.3 microns;

between about 20 to 28 percent of the tungsten carbide particles have a grain size of between about 0.3 to 0.5 microns;

between about 42 to 56 percent of the tungsten carbide particles have a grain size of between about 0.5 to 1 microns;

less than about 12 percent of the tungsten carbide particles are greater than 1 micron; and the mean grain size of the tungsten carbide particles is about 0.6±0.2 microns.

Viewed from a second aspect there is provided a method of making a cemented carbide body, the method comprising:

providing tungsten carbide powder having a mean equivalent circle diameter (ECD) size in the range from about 0.2 microns to about 0.6 microns; the ECD size distribution having the further characteristic that fewer than 45 percent of the carbide particles have a mean size of less than 0.3 microns; 30 to 40 percent of the carbide particles have a mean size of at least 0.3 microns and at most 0.5 microns; 18 to 25 percent of the carbide particles have a mean size of greater than 0.5 microns and at most 1 micron; fewer than 3 percent of the carbide particles have a mean size of greater than 1 micron;

the method further comprising:

milling the tungsten carbide powder with binder material comprising Co, Ni and Cr or chromium carbides; the equivalent total carbon comprised in the blended powder being about 6.12 percent with respect to the tungsten carbide, compacting the blended powder to form a green body; and sintering the green body to produce the cemented carbide body.

BRIEF DESCRIPTION OF THE DRAWINGS

Embodiments will now be described by way of example and with reference to the accompanying drawings in which.

DETAILED DESCRIPTION OF EMBODIMENTS

Figure 1:
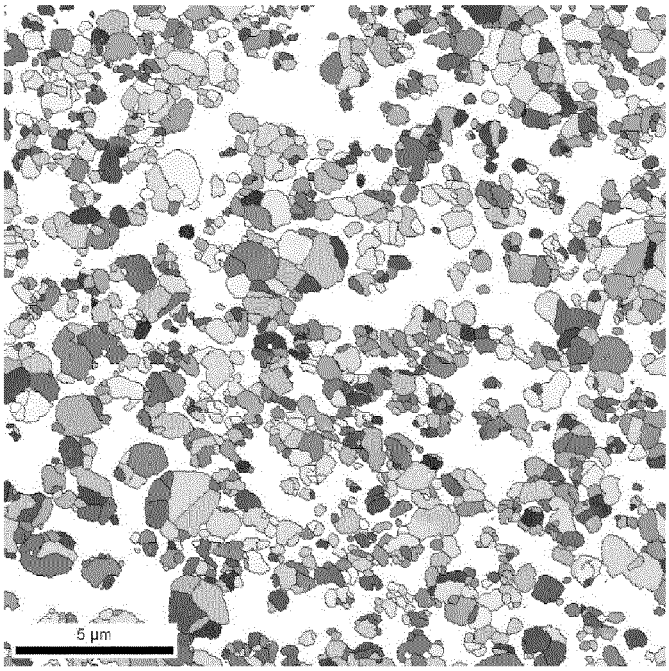
FIG. 1 is an EBSD image of tungsten carbide grains dispersed in a copper matrix according to a first example.

As used herein, a "catalyst material for diamond", also referred to as "solvent/catalyst for diamond", is a material that is capable of promoting the nucleation, growth or inter-bonding of diamond grains at a pressure and temperature at which diamond is thermodynamically stable. Catalyst materials for diamond may be metallic, such as cobalt, iron, nickel, manganese and alloys of these, or non-metallic.

As used herein, "polycrystalline diamond" (PCD) material comprises a mass of diamond grains, a substantial portion of which are directly inter-bonded with each other and in which the content of diamond is at least about 80 volume percent of the material. In one embodiment of PCD material, interstices between the diamond gains may be at least partly filled with a binder material comprising a catalyst for diamond. As used herein, "interstices" or "interstitial regions" are regions between the diamond grains of PCD material. In embodiments of PCD material, interstices or interstitial regions may be substantially or partially filled with a material other than diamond, or they may be substantially empty. As used herein, a "filler" material is a material that wholly or partially fills pores, interstices or interstitial regions within a structure, such as a polycrystalline structure. Thermally stable embodiments of PCD material may comprise at least a region from which catalyst material has been removed from the interstices, leaving interstitial voids between the diamond grains. As used herein, a "thermally stable PCD" structure is a PCD structure at least a part of which exhibits no substantial structural degradation or deterioration of hardness or abrasion resistance after exposure to a temperature above about 400 degrees centigrade.

As used herein, the grain sizes are expressed in terms of Equivalent Circle Diameter (ECD) according to the ISO FDIS 13067 standard. The ECD is obtained by measuring of the area A of each grain exposed at the polished surface and calculating the diameter of a circle that would have the same area A, according to the equation $ECD=(4\ A/\pi)^{1/2}$ (See section 3.3.2 of ISO FDIS 13067 "Microbeam analysis—Electron Backscatter Diffraction—Measurement of average grain size.", International Standards Organisation Geneva, Switzerland, 2011).

Embodiments PCD composite compact elements may comprise a PCD structure bonded along an interface to a cemented carbide substrate comprising particles of a metal carbide and a metallic binder material.

The practical use of cemented carbide grades with substantially lower cobalt content as substrates for PCD inserts is limited by the fact that some of the Co is required to migrate from the substrate into the PCD layer during the sintering process in order to catalyse the formation of the PCD. For this reason, it is more difficult to make PCD on substrate materials comprising lower Co contents, even though this may be desirable.

An embodiment of a PCD composite compact element may be made by a method including providing a cemented carbide substrate, contacting an aggregated, substantially unbonded mass of diamond particles against a surface of the substrate to form an pre-sinter assembly, encapsulating the pre-sinter assembly in a capsule for an ultra-high pressure furnace and subjecting the pre-sinter assembly to a pressure of at least about 5.5 GPa and a temperature of at least about 1,250 degrees centigrade, and sintering the diamond particles to form a PCD composite compact element comprising a PCD structure integrally formed on and joined to the cemented carbide substrate. In some embodiments of the invention, the pre-sinter assembly may be subjected to a pressure of at least about 6 GPa, at least about 6.5 GPa, at least about 7 GPa or even at least about 7.5 GPa.

The hardness of cemented tungsten carbide substrate may be enhanced by subjecting the substrate to an ultra-high pressure and high temperature, particularly at a pressure and temperature at which diamond is thermodynamically stable. The magnitude of the enhancement of the hardness may depend on the pressure and temperature conditions. In particular, the hardness enhancement may increase the higher the pressure. Whilst not wishing to be bound by a particular theory, this is considered to be related to the Co drift from the substrate into the PCD during press sintering, as the extent of the hardness increase is directly dependent on the decrease of Co content in the substrate.

In embodiments where the cemented carbide substrate does not contain sufficient solvent/catalyst for diamond, and where the PCD structure is integrally formed onto the substrate during sintering at an ultra-high pressure, solvent/catalyst material may be included or introduced into the aggregated mass of diamond grains from a source of the material other than the cemented carbide substrate. The solvent/catalyst material may comprise cobalt that infiltrates from the substrate in to the aggregated mass of diamond grains just prior to and during the sintering step at an ultra-high pressure. However, in embodiments where the content of cobalt or other solvent/catalyst material in the substrate is low, particularly when it is less than about 11 weight percent of the cemented carbide material, then an alternative source may need to be provided in order to ensure good sintering of the aggregated mass to form PCD.

Solvent/catalyst for diamond may be introduced into the aggregated mass of diamond grains by various methods, including blending solvent/catalyst material in powder form with the diamond grains, depositing solvent/catalyst material onto surfaces of the diamond grains, or infiltrating solvent/catalyst material into the aggregated mass from a source of the material other than the substrate, either prior to the sintering step or as part of the sintering step. Methods of depositing solvent/catalyst for diamond, such as cobalt, onto surfaces of diamond grains are well known in the art, and include chemical vapour deposition (CVD), physical vapour deposition (PVD), sputter coating, electrochemical methods, electroless coating methods and atomic layer deposition (ALD). It will be appreciated that the advantages and disadvantages of each depend on the nature of the sintering aid material and coating structure to be deposited, and on characteristics of the grain.

In one embodiment of a method of the invention, cobalt may be deposited onto surfaces of the diamond grains by first depositing a pre-cursor material and then converting the precursor material to a material that comprises elemental metallic cobalt. For example, in the first step cobalt carbonate may be deposited on the diamond grain surfaces using the following reaction:

$$Co(NO_3)_2+Na_2CO_3 \rightarrow CoCO_3+2NaNO_3$$

The deposition of the carbonate or other precursor for cobalt or other solvent/catalyst for diamond may be achieved by means of a method described in PCT patent publication number WO/2006/032982. The cobalt carbonate may then be converted into cobalt and water, for example, by means of pyrolysis reactions such as the following:

$$CoCO_3 \rightarrow CoO+CO_2$$

$$CoO+H_2 \rightarrow Co+H_2O$$

In another embodiment of the method of the invention, cobalt powder or precursor to cobalt, such as cobalt carbonate, may be blended with the diamond grains. Where a precursor to a solvent/catalyst such as cobalt is used, it may be necessary to heat treat the material in order to effect a reaction to produce the solvent/catalyst material in elemental form before sintering the aggregated mass.

According to the prior art documents WO2007/127680A1, US2011/0061944A1 and GB2393449A cemented carbide substrates for PCD may contain besides Co some nickel and chromium. However, these documents do not disclose the influence of nickel and chromium on the carbide erosion resistance. Also, there is no disclosure of the influence of WC grain size distribution, particularly the uniformity of the WC grains size distribution and the presence and percentage of abnormally large WC grains in the microstructure on the erosion resistance.

In connection with the present invention, it has now been unexpectedly appreciated that if the binder phase of cemented carbides contains nickel and chromium in a predetermined proportion, namely nickel between 10 and 50 wt. % and chromium between 0.1 and 10 wt. %, and the WC grain size distribution is in a particular range, the erosion resistance of cemented carbides may be dramatically improved. Also, the Vickers hardness, transverse rupture strength, indentation fracture toughness and wear-resistance of the cemented carbides containing the pre-determined proportions of nickel and chromium and the particular WC grain size distribution may be noticeably increased.

In some embodiments, the cemented carbide substrate may be formed of tungsten carbide particles bonded together by the binder material, the binder material comprising an alloy of Co, Ni and Cr. The tungsten carbide particles may form at least 70 weight percent and at most 95 weight percent of the substrate. The binder material may comprise between about 10 to 50 wt. % Ni, between about 0.1 to 10 wt. % Cr, and the remainder weight percent comprises Co. The size distribution of the tungsten carbide particles in the cemented carbide substrate ion some embodiments has the following characteristics:

- fewer than 17 percent of the carbide particles have a grain size of equal to or less than about 0.3 microns;
- between about 20 to 28 percent of the tungsten carbide particles have a grain size of between about 0.3 to 0.5 microns;
- between about 42 to 56 percent of the tungsten carbide particles have a grain size of between about 0.5 to 1 microns;
- less than about 12 percent of the tungsten carbide particles are greater than 1 micron; and
- the mean grain size of the tungsten carbide particles is about 0.6±0.2 microns.

In some embodiments, the binder additionally comprises between about 2 to 20 wt. % tungsten and between about 0.1 to 2 wt. % carbon It has also been surprisingly appreciated that if a layer of the substrate adjacent to the interface with the body of polycrystalline diamond material with thickness of around 100 microns contains a certain combination of cobalt, nickel and chromium, the wear-resistance of the PCD composite compact may be significantly improved.

The layer of the substrate adjacent to the interface with the body of polycrystalline diamond material may have a thickness of, for example, around 100 microns and may comprise tungsten carbide grains, and a binder phase. This layer may be characterised by the following elemental composition measured by means of Energy-Dispersive X-Ray Microanalysis (EDX):

- between about 0.5 to 2.0 wt % cobalt;
- between about 0.05 to 0.5 wt. % nickel;
- between about 0.05 to 0.2 wt. % chromium; and
- tungsten and carbon.

In a further embodiment, in the layer described above in which the elemental composition includes between about 0.5 to 2.0 wt % cobalt, between about 0.05 to 0.5 wt. % nickel and between about 0.05 to 0.2 wt. % chromium, the remainder is tungsten and carbon.

The layer of substrate may further comprise free carbon.

The magnetic properties of the cemented carbide material may be related to important structural and compositional characteristics. The most common technique for measuring the carbon content in cemented carbides is indirectly, by measuring the concentration of tungsten dissolved in the binder to which it is indirectly proportional: the higher the content of carbon dissolved in the binder the lower the concentration of tungsten dissolved in the binder. The tungsten content within the binder may be determined from a measurement of the magnetic moment, a, or magnetic saturation, $M_s=4\pi\sigma$, these values having an inverse relationship with the tungsten content (Roebuck (1996), "Magnetic moment (saturation) measurements on cemented carbide materials", *Int. J. Refractory Met.*, Vol. 14, pp. 419-424). The following formula may be used to relate magnetic saturation, Ms, to the concentrations of W and C in the binder:

$$M_s \propto [C]/[W] \times \text{wt. \% Co} \times 201.9 \text{ in units of } \mu T \cdot m^3/kg$$

The binder cobalt content within a cemented carbide material may be measured by various methods well known in the art, including indirect methods such as such as the magnetic properties of the cemented carbide material or more directly by means of energy-dispersive X-ray spectroscopy (EDX), or a method based on chemical leaching of Co.

The mean grain size of carbide grains, such as WC grains, may be determined by examination of micrographs obtained using a scanning electron microscope (SEM) or light microscopy images of metallurgically prepared cross-sections of a cemented carbide material body, applying the mean linear intercept technique, for example. Alternatively, the mean size of the WC grains may be estimated indirectly by measuring the magnetic coercivity of the cemented carbide material, which indicates the mean free path of Co intermediate the grains, from which the WC grain size may be calculated using a simple formula well known in the art. This formula quantifies the inverse relationship between magnetic coercivity of a Co-cemented WC cemented carbide material and the Co mean free path, and consequently the mean WC grain size. Magnetic coercivity has an inverse relationship with MFP.

As used herein, the "mean free path" (MFP) of a composite material such as cemented carbide is a measure of the mean distance between the aggregate carbide grains cemented within the binder material. The mean free path characteristic of a cemented carbide material may be measured using a micrograph of a polished section of the material. For example, the micrograph may have a magnification of about 1500×. The MFP may be determined by measuring the distance between each intersection of a line and a grain boundary on a uniform grid. The matrix line segments, Lm, are summed and the grain line segments, Lg, are summed. The mean matrix segment length using both axes is the "mean free path". Mixtures of multiple distributions of tungsten carbide particle sizes may result in a wide distribution of MFP values for the same matrix content.

The concentration of W in the Co binder depends on the C content. For example, the W concentration at low C contents is significantly higher. The W concentration and the C content within the Co binder of a Co-cemented WC (WC—Co) material may be determined from the value of the magnetic saturation. The magnetic saturation $4\pi\sigma$ or magnetic moment $\sigma$ of a hard metal, of which cemented tungsten carbide is an example, is defined as the magnetic moment or magnetic saturation per unit weight. The magnetic moment, $\sigma$, of pure Co is 16.1 micro-Tesla times cubic meter per kilogram ($\mu T \cdot m^3/kg$), and the induction of saturation, also referred to as the magnetic saturation, $4\pi\sigma$, of pure Co is 201.9 $\mu T \cdot m^3/kg$.

In some embodiments, the cemented carbide substrate may have a mean magnetic coercivity of at least about 100 Oe and at most about 145 Oe, and a magnetic moment of specific magnetic saturation with respect to that of pure Co of at least about 89 percent to at most about 97 percent.

A desired MFP characteristic may be accomplished several ways known in the art. For example, a lower MFP value may be achieved by using a lower metal binder content. A practical lower limit of about 3 weight percent cobalt applies for cemented carbide and conventional liquid phase sintering. In an embodiment where the cemented carbide substrate is subjected to an ultra-high pressure, for example a pressure greater than about 5 GPa and a high temperature (greater than about 1,400° C. for example), lower contents of metal binder, such as cobalt, may be achieved. For example, where the cobalt content is about 3 weight percent and the mean size of the WC grains is about 0.5 micron, the MFP would be about 0.1 micron, and where the mean size of the WC grains is about 2 microns, the MFP would be about 0.35 microns, and where the mean size of the WC grains is about 3 microns, the MFP would be about 0.7 microns. These mean grain sizes correspond to a single powder class obtained by natural comminution processes that generate a log normal distribution of particles. Higher matrix (binder) contents would result in higher MFP values.

Changing grain size by mixing different powder classes and altering the distributions may achieve a whole spectrum of MFP values depending on the particulars of powder processing and mixing. The exact values would have to be determined empirically.

In some embodiments, the body of polycrystalline diamond material comprises Co, Ni and Cr.

The binder material may include at least about 0.1 weight percent to at most about 5 weight percent one or more of V, Ta, Ti, Mo, Zr, Nb and Hf in solid solution.

In further embodiments, the polycrystalline diamond (PCD) composite compact element may include at least about 0.01 weight percent and at most about 2 weight percent of one or more of Re, Ru, Rh, Pd, Re, Os, Ir and Pt.

A polycrystalline diamond (PCD) composite compact element according to some embodiments may have a specific weight loss in an erosion test in a recirculating rig generating an impinging jet of liquid-solid slurry below $2\times10^{-3}$ g/cm$^3$ at the following testing conditions: a temperature of 50° C., an impingement angle of 45°, a slurry velocity of 20 m/s, a pH of 8.02, a duration of 3 hours, and a slurry composition in 1 cubic meter water of: 40 kg Bentonite; 2 kg Na2CO3; 3 kg carboxymethyl cellulose, 5 liters Some embodiments of a cemented carbide body may be formed by providing tungsten carbide powder having a mean equivalent circle diameter (ECD) size in the range from about 0.2 microns to about 0.6 microns, the ECD size distribution having the further characteristic that fewer than 45 percent of the carbide particles have a mean size of less than 0.3 microns; 30 to 40 percent of the carbide particles have a mean size of at least 0.3 microns and at most 0.5 microns; 18 to 25 percent of the carbide particles have a mean size of greater than 0.5 microns and at most 1 micron; fewer than 3 percent of the carbide particles have a mean size of greater than 1 micron. The tungsten carbide powder is milled with binder material comprising Co, Ni and Cr or chromium carbides, the equivalent total carbon comprised in the blended powder being, for example, about 6 percent with respect to the tungsten carbide. The blended powder is then compacted to form a green body and the green body is sintered to produce the cemented carbide body.

The sintering the green body may take place at a temperature of, for example, at least 1,400 degrees centigrade and at most 1,440 degrees centigrade for a period of at least 65 minutes and at most 85 minutes.

In some embodiments, the equivalent total carbon (ETC) comprised in the cemented carbide material is about 6.12 percent with respect to the tungsten carbide.

The size distribution of the tungsten carbide powder may, in some embodiments, have the characteristic of a mean ECD of 0.4 microns and a standard deviation of 0.1 microns.

Embodiments are described in more detail below with reference to the example below which is not intended to be limiting.

EXAMPLE

A batch of carbide substrates for PCD was produced by a conventional powder metallurgy route. First, a 5 kg powder mixture was produced. A WC powder was milled with 9.75 wt. % Co powder with mean grain size of nearly 1.5 μm, 2.95 wt. % Ni powder with mean grain size of roughly 2.5 μm and 0.3 wt. % Cr3C2 powder with mean grain size 1.6 μm in a ball mill with 30 kg carbide balls and 100 g paraffin wax. Once the powder had been dried, it was granulated and compacted to form substrates for PCD in the form of green bodies. The equivalent total carbon (ETC) comprised in the cemented carbide material was 6.12 percent with respect to WC.

The green bodies were sintered by means of a Sinterhip™ furnace at 1,420 degrees centigrade for about 75 min, 45 min of which was carried out in vacuum and 30 min of which was carried out in a HIP apparatus in an Ar at a pressure of about 40 bars. Afterwards a layer of polycrystalline diamond was obtained on the carbide substrates by use of conventional procedures using high-pressure and high-temperatures to produce PCD cutters.

After this, metallurgical cross-sections of the cutters were made and the composition of a layer of the carbide substrate adjacent to the PCD layer was examined by mean of energy-dispersive X-ray microanalysis (EDX). Also the PCD layer was cut off and the magnetic properties of the carbide substrates were examined.

The size distribution of the WC grains in the starting WC powder was measured as follows. The WC powder was blended with 50 weight percent Cu powder and the resulting blend was compacted and sintered at 1,100 degrees centigrade in a vacuum for 30 min. As it is known that WC does not substantially dissolve in Cu or react with Cu, the original size distribution of the WC is preserved within the Cu matrix. The sintered Cu-based body was sectioned and prepared for microscopic metallurgical analysis, and the size distribution of the WC grains embedded in the Cu matrix was measured. An EBSD image of the WC grains dispersed in the Cu matrix is shown in FIG. 1.

Figure 2:
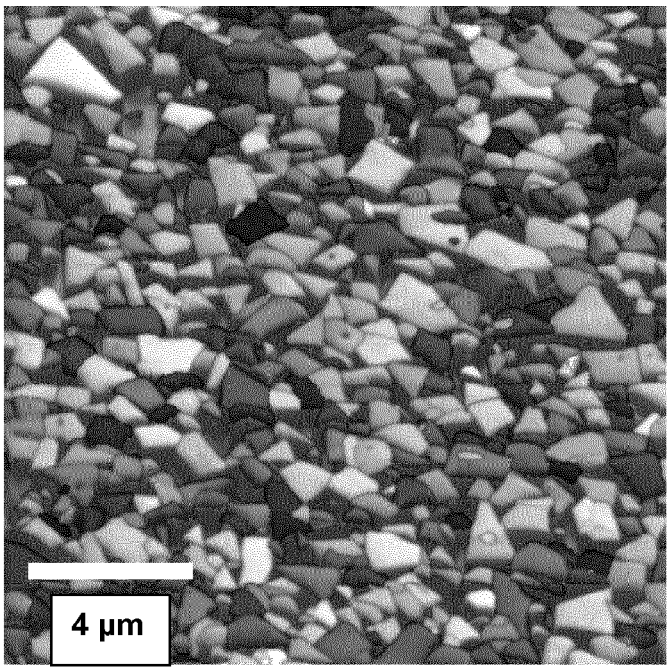
FIG. 2 is an EBSD image of tungsten carbide grains dispersed in a sintered cemented carbide body according to the first example.

The same method was used to measure the size distribution of the WC grains in the Cu body and in the sintered cemented carbide bodies and an EBSD image of the WC grains in the sintered cemented carbide body is shown in FIG. 2.

Electron Backscatter Diffraction (EBSD) images were obtained by means of a high-resolution scanning electron microscope (HRSEM). The grain sizes were obtained and are expressed in terms of Equivalent Circle Diameter (ECD) according to the ISO FDIS 13067 standard. The ECD is obtained by measuring of the area A of each grain exposed at the polished surface and calculating the diameter of a circle that would have the same area A, according to the equation $ECD=(4\ A/\pi)^{1/2}$ (See section 3.3.2 of ISO FDIS 13067 "Microbeam analysis—Electron Backscatter Diffraction—Measurement of average grain size.", International Standards Organisation Geneva, Switzerland, 2011). The mean grain sizes of WC grains of the original WC powder was equal to 0.4 μm and in the sintered cemented carbide was equal to 0.6 μm. The grain size distributions of the grains in the original WC powder and sintered cemented carbide are shown in Table 1. As can be seen below, the grain size distribution of the cemented carbide is very narrow with over 77% of WC grains in the range between 0.4 and 1.0 μm and very few WC grains are larger than 1.5 μm, which is expected to lead to a high combination of hardness, fracture toughness, wear- and erosion resistance.

TABLE 1

Grain size distribution of WC in the sintered cemented carbide and original powder.

| sample | <0.3 μm | 0.3-0.5 μm | 0.5-1.0 μm | 1.0-1.5 μm | >1.5 μm |
|---|---|---|---|---|---|
| Sintered cemented carbide | 13.5% | 23.6% | 53.7% | 8.7% | 0.5% |
| Original WC | 39.8% | 35.4% | 22.9% | 1.7% | 0.2% |

The magnetic coercivity of the carbide substrates was found to be equal to roughly 130 Oe and their magnetic moment to be equal to 14.5 $Gcm^3/g$, which is equal to 92.4% of the theoretical value for nominally pure Co. The Vickers hardness of the substrates was equal to HV10=1350, transverse rupture strength was equal to 3800 MPa, indentation fracture toughness was equal to 15.7 MPa $m^{1/2}$ and wear measured according to the ASTM B611 test was equal to $1.9\times10^{-4}$ $cm^3$/rev. The cemented carbide substrates were examined in an erosion test in a recirculating rig generating impinging jet of liquid-solid slurry at the following testing conditions: temperatures—50° C., impingement angle—45°, slurry velocity—20 m/s, pH—8.02, duration—3 hrs, slurry composition in 1 cubic meter water: Bentonite—40 kg; Na2CO3—2 kg, carboxymethyl cellulose—3 kg, polyacrylamide solution—5 l, quartz sand—1 kg. The specific weigh loss was found to be equal to $1.1\times10^{-3}$ $g/cm^3$.

Also, conventional cemented carbide substrates with 13 wt. % Co not containing chromium and nickel of the standard carbide grade were examined in the same test on erosion resistance. Table 2 shows the WC grain size distribution of the conventional grade indicating that there are much more grains with grain sizes of 1.0 to 1.5 μm and significantly more abnormally large WC grains with a grain size of more than 1.5 μm. The wide range of WC grain size distribution with a large number of large and abnormally large WC grains in the conventional cemented carbide is expected to result in a decreased combination of hardness, fracture toughness, and wear- and erosion resistance.

TABLE 2

Grain size distribution of WC in the conventional cemented carbide

| sample | <0.3 μm | 0.3-0.5 μm | 0.5-1.0 μm | 1.0-1.5 μm | >1.5 μm |
|---|---|---|---|---|---|
| Sintered cemented carbide | 9.4% | 15.7% | 49.3% | 21.1% | 4.5% |

The mean WC grain size of this grade was equal to 0.7 μm. The magnetic coercivity of the carbide substrates was found to be equal to roughly 109 Oe and their magnetic moment to be equal to 20.5 $Gcm^3/g$, which is equal to 98.0% of the theoretical value for nominally pure Co. The Vickers hardness of the substrates was equal to HV10=1200, transverse rupture strength was equal to 3420 MPa, indentation fracture toughness was equal to 14.6 MPa $m^{1/2}$ and wear measured according to the ASTM B611 test was equal to $2.8\times10^4$ $cm^3$/rev. Therefore, as a result of the non-uniform grain size distribution and the presence of more than 4.5% of WC grains larger than 1.5 μm in the conventional cemented carbide it is characterised by a decreased combination hardness, transverse rupture strength and fracture toughness.

The specific weight loss of the conventional cemented carbide in the erosion-resistance test described above was equal to $3.2\times10^{-3}$ $g/cm^3$, therefore the erosion resistance of the cemented carbide according to an embodiment of the present invention was higher than that of the conventional one by roughly a factor of 3, which is a result of its both the uniform grain size distribution and the presence of certain amounts of chromium and nickel in the binder. It was found that if the binder contains less than 10 wt. % Ni its corrosion/erosion resistance is noticeably decreased, and if it contains more than 50% Ni its mechanical properties (hardness, transverse rupture strength, hardness and wear-resistance) are significantly reduced. If the binder of cemented carbide contains less than 0.1% Cr its corrosive/erosive resistance becomes insignificant, and if it contains more than 10 wt. % Cr, chromium precipitates as a second carbide phase resulting in the degradation of mechanical properties (fracture toughness and transverse rupture strength).

The layer of the carbide substrate of roughly 100 μm in thickness adjacent to the PCD layer was found to have the following composition according to the EDX results: Co—1.5 wt %, Ni—0.2 wt. %, Cr 0.1 wt. %, the rest is tungsten plus carbon.

Whilst not wishing to be bound by a particular theory, it is believed that some embodiments may significantly improve the erosion resistance of carbide by employing a microstructure of the cemented carbide with tailored WC grain size distribution in combination with a Co-based binder alloyed by chromium and nickel. This is found to lead to improved performance of a PCD cutter comprising a body of PCD material bonded to the carbide substrate.

The invention claimed is:

1. A polycrystalline diamond (PCD) composite compact element comprising:

a body of polycrystalline diamond material; and a cemented carbide substrate bonded to the body of polycrystalline material along an interface;

the cemented carbide substrate comprising tungsten carbide particles bonded together by a binder material, the binder material comprising an alloy of Co, Ni and Cr;

the tungsten carbide particles in the cemented carbide substrate having a size distribution, and the tungsten carbide particles forming at least 70 weight percent and at most 95 weight percent of the substrate;

wherein the binder material comprises between about 10 to 50 wt. % Ni, between about 0.1 to 10 wt. % Cr, and the remainder weight percent comprising Co;

wherein the size distribution of the tungsten carbide particles in the cemented carbide substrate has the following characteristics:

fewer than 17 percent of the carbide particles have a grain size of equal to or less than about 0.3 microns;

between about 20 to 28 percent of the tungsten carbide particles have a grain size of between about 0.3 to 0.5 microns;

between about 42 to 56 percent of the tungsten carbide particles have a grain size of between about 0.5 to 1 microns;

less than about 12 percent of the tungsten carbide particles are greater than 1 micron; and the mean grain size of the tungsten carbide particles is about 0.6±0.2 microns.

2. The polycrystalline diamond (PCD) composite compact element according to claim 1, wherein the binder material comprises between about 20 to 40 wt. % Ni, between about 1 to 7 wt. % Cr, and the remainder weight percent comprising Co.

3. The polycrystalline diamond (PCD) composite compact element according to claim 1, wherein the binder additionally comprises between about 2 to 20 wt. % tungsten and between about 0.1 to 2 wt. % carbon.

4. The polycrystalline diamond (PCD) composite compact element according to claim 3 wherein the layer of substrate further comprises free carbon.

5. The polycrystalline diamond (PCD) composite compact element according to claim 1, wherein a layer of the substrate adjacent to the interface with the body of polycrystalline diamond material has a thickness of around 100 microns and comprises tungsten carbide grains, a binder phase, and is characterised by the following elemental composition measured by means of Energy-Dispersive X-Ray Microanalysis (EDX):

between about 0.5 to 2.0 wt % cobalt;

between about 0.05 to 0.5 wt. % nickel;

between about 0.05 to 0.2 wt. % chromium; and the remainder comprising tungsten and carbon.

6. The polycrystalline diamond (PCD) composite compact element according to claim 1, wherein the cemented carbide substrate has a mean magnetic coercivity of at least about 100 Oe and at most about 145 Oe, and a magnetic moment or magnetic saturation with respect to that of pure Co of at least about 89 percent to at most about 97 percent.

7. The polycrystalline diamond (PCD) composite compact element according to claim 1, wherein the body of polycrystalline diamond material comprises Co, Ni and Cr.

8. The polycrystalline diamond (PCD) composite compact element as claimed in claim 1, wherein the binder material includes at least about 0.1 weight percent to at most about 5 weight percent one or more of V, Ta, Ti, Mo, Zr, Nb and Hf in solid solution.

9. The polycrystalline diamond (PCD) composite compact element as claimed in claim 1, comprising at least about 0.01 weight percent and at most about 2 weight percent of one or more of Re, Ru, Rh, Pd, Re, Os, Ir and Pt.

10. The polycrystalline diamond (PCD) composite compact element as claimed in claim 1, wherein its specific weight loss in an erosion test in a recirculating rig generating an impinging jet of liquid-solid slurry is below $2\times10^{-3}$ g/cm$^3$ at the following testing conditions: a temperature of 50° C., an impingement angle of 45°, a slurry velocity of 20 m/s, a pH of 8.02, a duration of 3 hours, and a slurry composition in 1 cubic meter water of: 40 kg Bentonite; 2 kg Na2CO3; 3 kg carboxymethyl cellulose, 5 liters polyacrylamide solution; and 1 kg quartz sand.

* * * * *